US010429096B2

(12) United States Patent
Karlstedt et al.

(10) Patent No.: US 10,429,096 B2
(45) Date of Patent: Oct. 1, 2019

(54) COMBINED HEATER AND ACCUMULATOR ASSEMBLIES

(71) Applicant: Laird Technologies, Inc., Earth City, MO (US)

(72) Inventors: Dan Martin Gustav Karlstedt, Torslanda (SE); Christoph Bauckhage, North Andover, MA (US); Paul Damian Crocco, Durham, NC (US)

(73) Assignee: Laird Technologies, Inc., Chesterfield, MO (US)

( * ) Notice: Subject to any disclaimer, the term of this patent is extended or adjusted under 35 U.S.C. 154(b) by 282 days.

(21) Appl. No.: 15/158,226

(22) Filed: May 18, 2016

(65) Prior Publication Data

US 2017/0276403 A1 Sep. 28, 2017

Related U.S. Application Data

(60) Provisional application No. 62/313,085, filed on Mar. 24, 2016.

(51) Int. Cl.
*F24H 1/20* (2006.01)
*F28F 13/06* (2006.01)
(Continued)

(52) U.S. Cl.
CPC ..... *F24H 1/202* (2013.01); *F24H 1/188* (2013.01); *F24H 9/001* (2013.01); *F24D 3/1008* (2013.01)

(58) Field of Classification Search
CPC ..... F24H 1/202; F24H 9/001; F24H 1/188; F24H 1/32; H05B 1/0297; F24D 3/1008; F24D 3/1016; F24D 3/1033
See application file for complete search history.

(56) References Cited

U.S. PATENT DOCUMENTS 3,499,481 A 3/1970 Avrea
3,952,182 A * 4/1976 Flanders ..... F24H 1/102 392/466
(Continued)

FOREIGN PATENT DOCUMENTS

EP 0663576 A1 * 7/1995 ..... F24H 1/18
EP 1630487 A1 3/2006
(Continued)

OTHER PUBLICATIONS

International Search Report and Written Opinion dated Jul. 3, 2017 for PCT Application No. PCT/US2017/023602 filed Mar. 23, 2017 which claims priority to the instant application, 19 pages.
(Continued)

*Primary Examiner* — Steven S Anderson, II
(74) *Attorney, Agent, or Firm* — Harness, Dickey & Pierce, P.L.C.; Anthony G. Fussner

(57) ABSTRACT

Exemplary embodiments are provided of combined heater and accumulator assemblies. In an exemplary embodiment, an assembly generally includes an enclosure including a first portion, a second portion, and a divider between the first and second portions. The assembly also includes an inlet through which coolant may enter an interior of the second portion, and an outlet through which the coolant may exit the interior of the second portion. The assembly further includes a heat source operable for supplying heat for heating the coolant within the interior of the second portion.

30 Claims, 10 Drawing Sheets

(51) Int. Cl.

| | |
|---|---|
| ***F28F 1/40*** | (2006.01) |
| ***F24H 9/00*** | (2006.01) |
| ***H05B 1/02*** | (2006.01) |
| ***F24H 1/18*** | (2006.01) |
| *F24D 3/10* | (2006.01) |

(56) References Cited

U.S. PATENT DOCUMENTS

| | | | | |
|---|---|---|---|---|
| 4,451,210 | A * | 5/1984 | Shaubach | F04B 19/24 417/209 |
| 4,595,037 | A * | 6/1986 | LeBreton | F15B 1/14 138/30 |
| 6,035,102 | A * | 3/2000 | Bakke | A61M 5/44 165/46 |
| 6,041,742 | A | 3/2000 | Drake | |
| 6,588,377 | B1 * | 7/2003 | Leary | F24D 3/1008 122/13.01 |
| 6,987,668 | B2 | 1/2006 | Kitano et al. | |
| 9,279,606 | B2 | 3/2016 | Kim | |
| 2002/0078702 | A1 | 6/2002 | Makizono et al. | |
| 2003/0056532 | A1 * | 3/2003 | Dickson | F25B 43/006 62/471 |
| 2010/0155012 | A1 * | 6/2010 | Lemee | F25B 40/00 165/10 |
| 2011/0073190 | A1 * | 3/2011 | Peteri | F24H 1/188 137/1 |
| 2012/0026256 | A1 | 2/2012 | Shibata | |
| 2012/0255706 | A1 * | 10/2012 | Tadayon | F28D 20/0039 165/47 |
| 2013/0025696 | A1 * | 1/2013 | Yang | F16L 55/05 137/14 |
| 2014/0230471 | A1 | 8/2014 | Bart | |

FOREIGN PATENT DOCUMENTS

| | | | | |
|---|---|---|---|---|
| EP | 2287535 | A1 | 2/2011 | |
| GB | 845318 | A | 8/1960 | |
| GB | 934604 | A * | 8/1963 | F16J 15/3268 |
| JP | H0640754 | A | 5/1994 | |
| SU | 987351 | * | 1/1983 | |
| WO | WO-2013089382 | A1 | 6/2013 | |
| WO | WO-2015152450 | A1 | 10/2015 | |

OTHER PUBLICATIONS

Bellofram Rolling Diaphragm Design Manual, Bellofram Corporation, Copyright 1998, 36 pages.

European Search Report for European application No. EP17771063 which claims priority to the instant application, dated Oct. 29, 2018, 4 pages.

* cited by examiner

COMBINED HEATER AND ACCUMULATOR ASSEMBLIES

CROSS-REFERENCE TO RELATED APPLICATION

This application claims priority to and the benefit of U.S. Provisional Patent Application No. 62/313,085 filed Apr. 29, 2016. The entire disclosure of the above application is incorporated herein by reference.

FIELD

The present disclosure generally relates to combined heater and accumulator assemblies.

BACKGROUND

This section provides background information related to the present disclosure which is not necessarily prior art.

For systems with closed liquid circuits, an accumulator may be used to mitigate volume changes due to temperature changes. Some cooling systems may include a separate heater on a liquid heat exchanger and rely upon a "cool down reheat" method in order to accurately control temperature outlet.

DRAWINGS

The drawings described herein are for illustrative purposes only of selected embodiments and not all possible implementations, and are not intended to limit the scope of the present disclosure.

Figure 13:
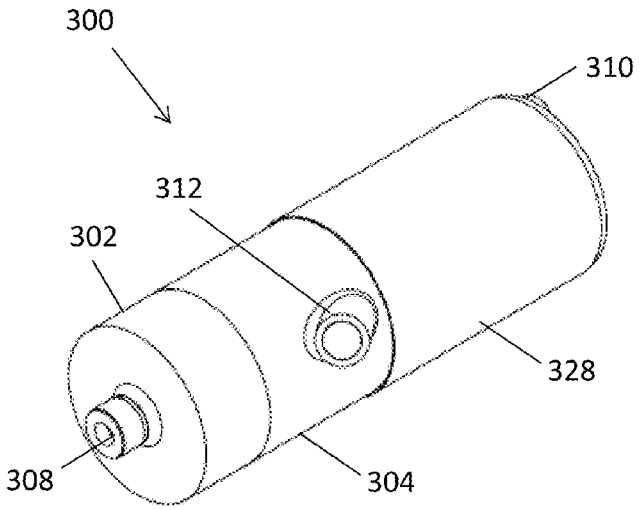
FIG. 13 is a perspective view of a heater/accumulator assembly according to another exemplary embodiment.
Figure 14:
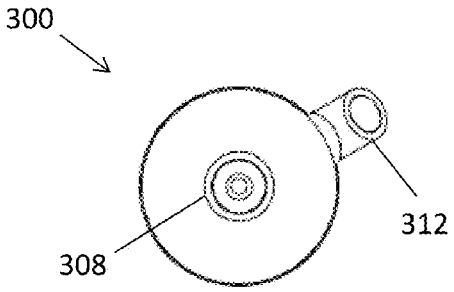
FIG. 14 is an end view of the heater/accumulator assembly shown in FIG. 13, and showing a gas fill valve and an outlet of the heater/accumulator assembly.
Figure 15:
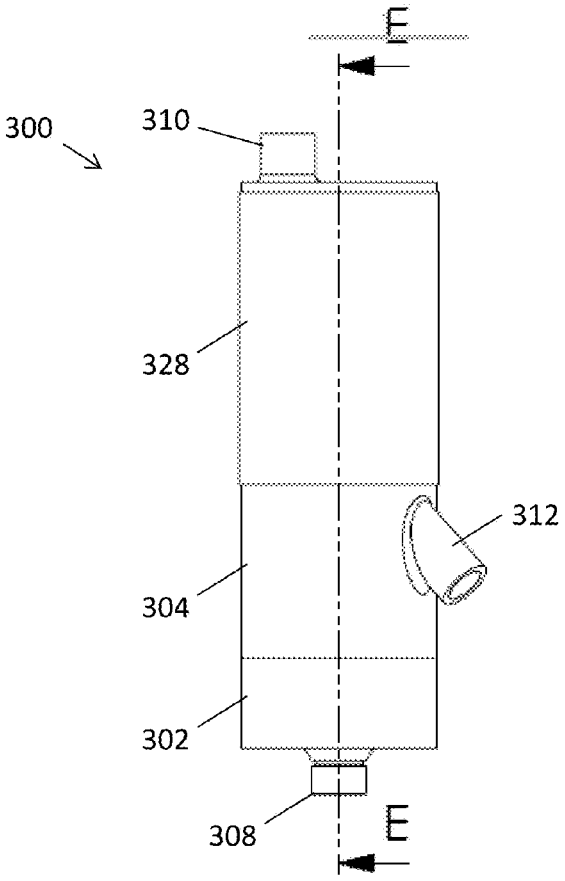
Figure 16:
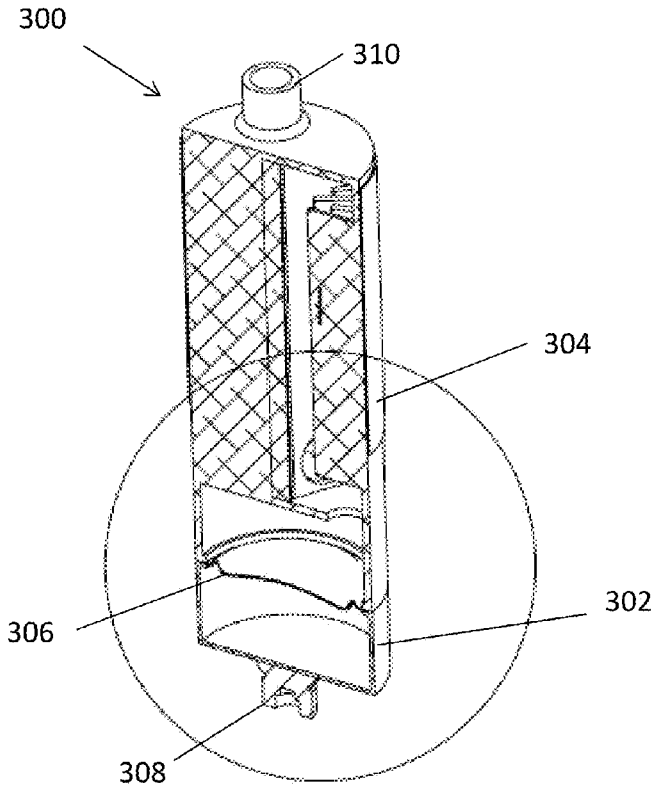
Figure 17:
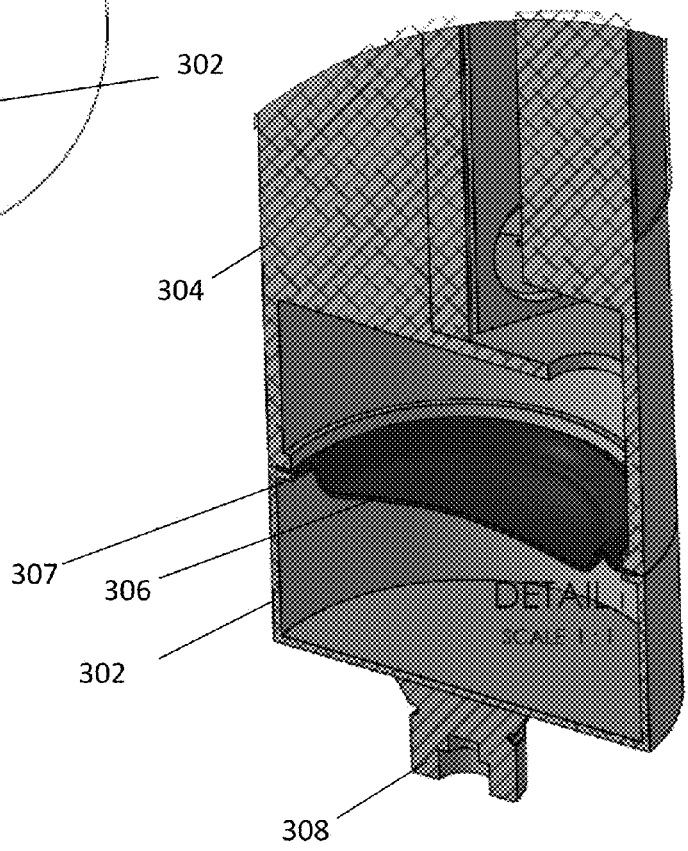
Figure 18:
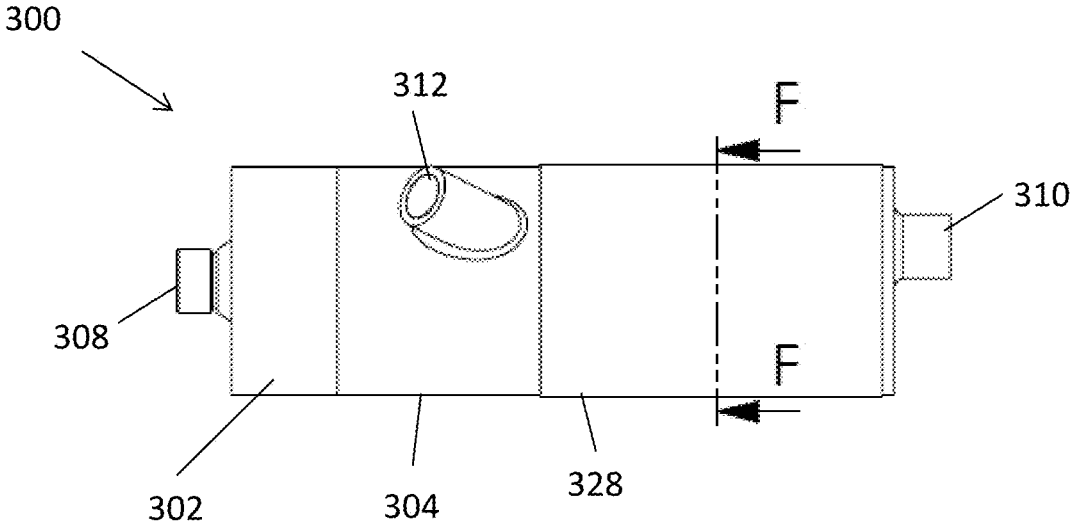
Figure 19:
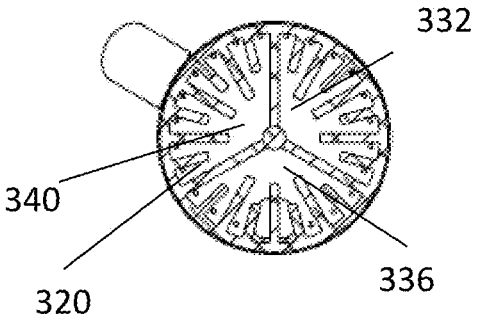
Figure 20:
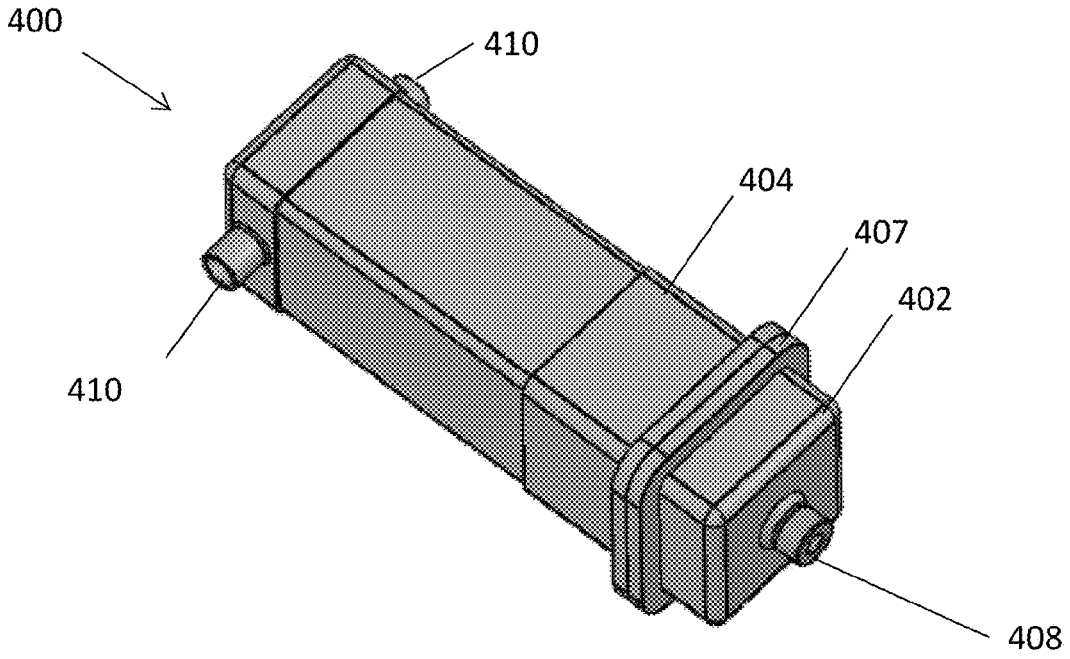
Figure 21:
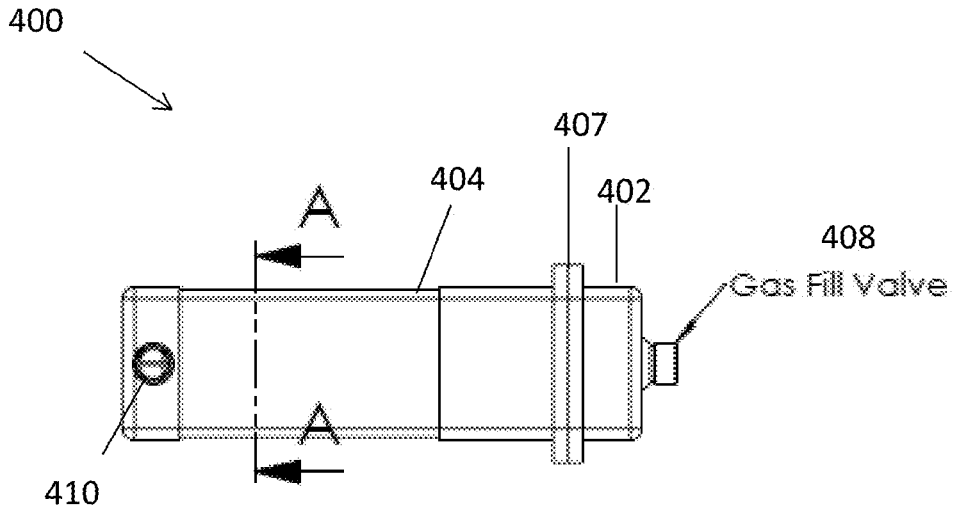
Figure 22:
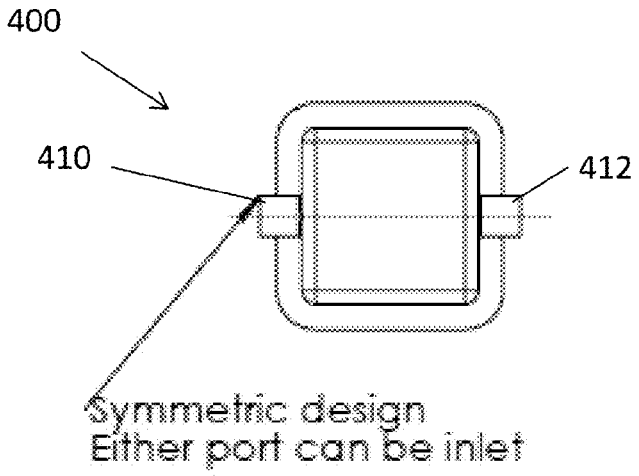
Figure 23:
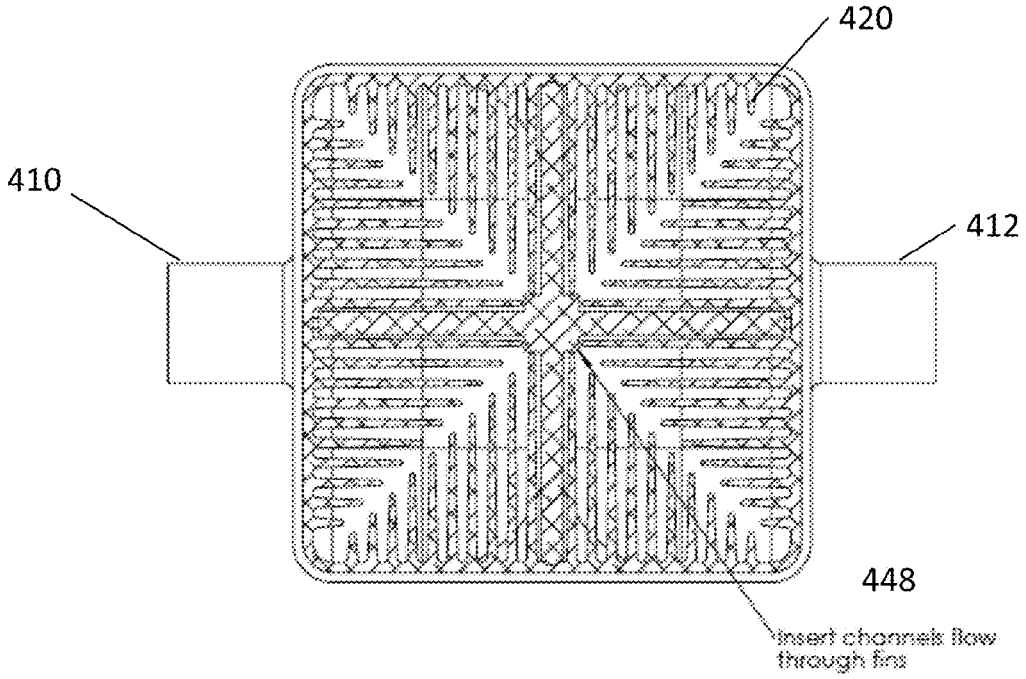
Figure 24:
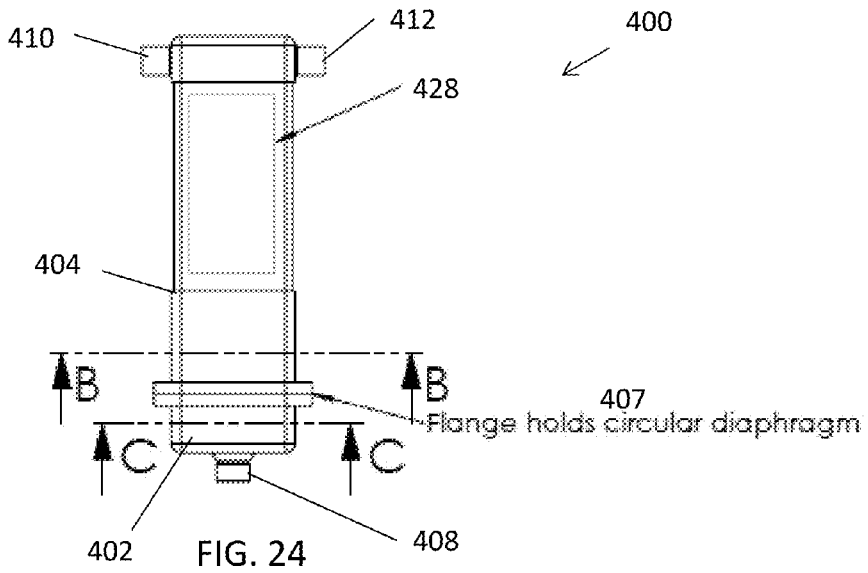
Figure 25:
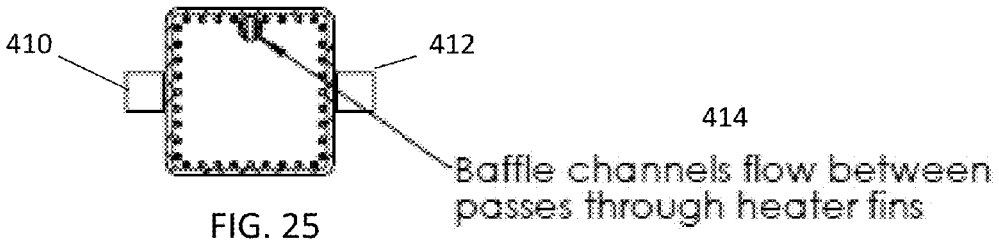
Figure 26:
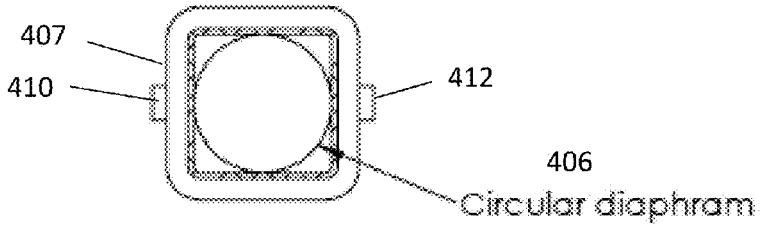

FIG. 15 a side view of the heater/accumulator assembly shown in FIG. 13;

FIG. 16 is a cross-sectional view of the heater/accumulator assembly taken along the line E-E in FIG. 15, and showing the interior of the accumulator portion and the heater portion of the enclosure of the heater/accumulator assembly;

FIG. 17 is a detail view of the circled portion of the heater/accumulator assembly shown in FIG. 16;

FIG. 18 another side view of the heater/accumulator assembly shown in FIG. 13;

FIG. 19 is a cross-sectional view taken along the line F-F in FIG. 18, and showing first, second, and third passes for coolant flow within the interior of the heater portion of the enclosure of the heater/accumulator assembly;

FIG. 20 is a perspective view of a heater/accumulator assembly according to another exemplary embodiment;

FIG. 21 is a side view of the heater/accumulator assembly shown in FIG. 20, and showing a gas fill valve and a port of the heater/accumulator assembly;

FIG. 22 is an end view of the heater/accumulator assembly shown in FIG. 20, and showing the two portions of the heater/accumulator assembly, which has a symmetric design such that either port can be used as the inlet;

FIG. 23 is a cross-sectional view of the heater/accumulator assembly taken along the line A-A in FIG. 20, and showing an insert for channeling coolant flow through fins within the interior of the heater portion of the enclosure of the heater/accumulator assembly;

FIG. 24 is a side view of the heater/accumulator assembly shown in FIG. 20, and showing a flange for holding a circular diaphragm and a rectangular heater that may be applied externally on each of the four side surfaces of the heater/accumulator assembly;

FIG. 25 is a cross-sectional view of the heater/accumulator assembly taken along the line B-B in FIG. 24, and showing a baffle for channeling flow between passes through heater fins within the interior of the heater portion of the enclosure of the heater/accumulator assembly; and FIG. 26 is a cross-sectional view of the heater/accumulator assembly taken along the line C-C in FIG. 24, and showing a circular diaphragm of the heater/accumulator assembly.

DETAILED DESCRIPTION

Example embodiments will now be described more fully with reference to the accompanying drawings.

Systems with closed liquid circuits may include an accumulator to mitigate volume changes due to temperature changes. Some cooling systems may include a separate heater on a liquid heat exchanger and rely upon a "cool down reheat" method in order to accurately control temperature outlet. But such conventional systems rely upon separate heater and accumulator sub-assemblies, that increases costs and increase the difficulty, and therefore, the time required, to assemble such systems having multiple sub-assemblies.

Disclosed herein are exemplary embodiments of combined heater and accumulator assemblies. In exemplary embodiments, a heater sub-assembly and an accumulator sub-assembly are combined or integrated into a single assembly configured to be operable for mitigating volume change mitigation. By combining the heater and accumulator functions into a single integrated assembly, costs may be reduced and installation/implementation may be less complicated.

In exemplary embodiments, a heater/accumulator assembly generally comprises an enclosure (e.g., a housing, a pressure vessel, etc.) having an accumulator portion (broadly, a first portion) and a heater portion or coolant flow chamber (broadly, a second portion). A flexible membrane or diaphragm (broadly, a divider) is between the accumulator portion and the heater portion. The assembly includes an inlet through which coolant may enter an interior of the heater portion, and an outlet through which the coolant may exit the interior of the heater portion. The assembly also includes a heat source operable for supplying heat for heating the coolant within the interior of the heater portion, such as when the coolant flows through the interior of the heater portion from the inlet to the outlet.

The flexible membrane or diaphragm may be operable for dividing or separating the enclosure (e.g., a cylindrical tubular housing or pressure vessel, etc.) into first and second cavities or compartments (broadly, first and second portions). The membrane may comprise a material that is impermeable or substantially impermeable to the coolant and pressurized fluid (e.g., nitrogen gas, air, liquid, other fluids, etc.) that may be used for pressurizing the accumulator portion. In which case, the membrane may be operable as a barrier that prevents the pressurized fluid from flowing from the accumulator portion into the heater portion and also prevents the coolant from flowing from the heater portion into the accumulator portion. The flexible membrane or diaphragm (e.g., an elastomer or rubber plate, etc.) may be coupled (e.g., welded, adhesively bonded, mechanically fastened etc.) to an inner surface generally between the accumulator and heater portions of the enclosure.

Various materials may be used for the membrane or diaphragm in exemplary embodiments. By way of example only, the membrane or diaphragm may comprise one or more of isobutyl isoprene rubber (IIR), ethylene propylene diene monomer rubber (EPDM), perfluoro-elastomers (FFKM), fluoroelastomers (FPM), nitrile rubber (NBR), polyvinyl chloride (PVC), other elastomers, etc. A wide range of coolants may be used in exemplary embodiments. By way of example, the coolant may comprise one or more of ethylene glycol water (EGW), water, water-glycol mixtures, electronics cooling fluid (e.g., fluorinert, etc.), oil, inert fluorinated fluid (e.g., perfluoropolyether fluorinated fluids, galden PFPE fluid, etc.), deionized water, demineralized water, ultrapure water, fuel, different mixes of water with additives for corrosion and other inhibitors, a dielectric fluid (e.g., refrigerants, flourinerts, etc.), other coolants, etc.

Figure 1:
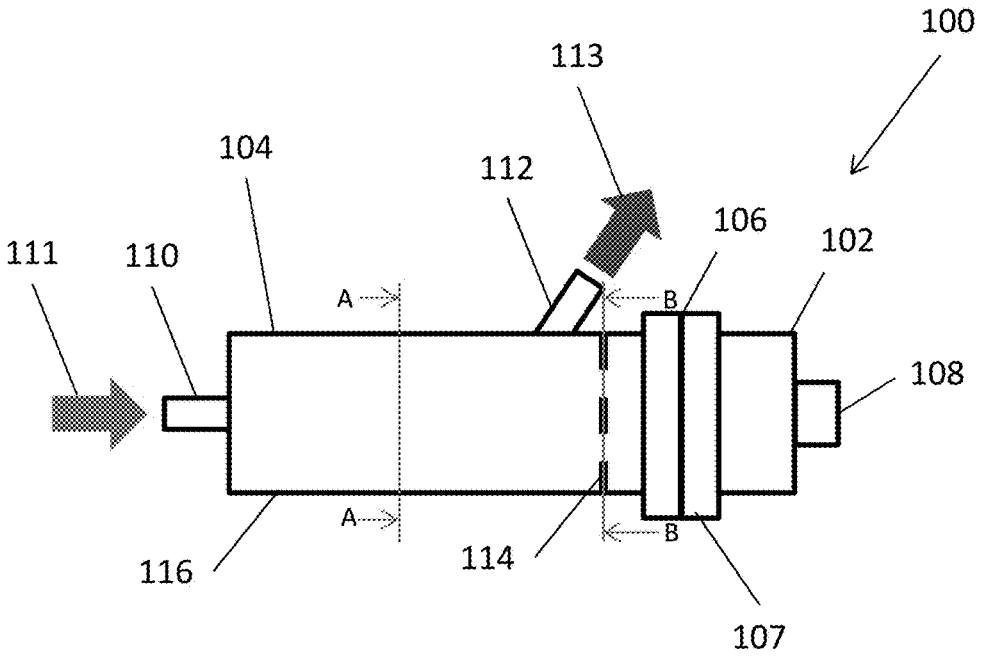
FIG. 1 illustrates a heater/accumulator assembly according to an exemplary embodiment.

Referring now to the figures, FIG. 1 illustrates an exemplary embodiment of a heater/accumulator assembly 100 embodying one or more aspects of the present disclosure. The assembly 100 includes an enclosure (e.g., pressure vessel, pipe, tube, tank, housing, etc.) having an accumulator portion 102 (broadly, a first portion) and a heater portion or coolant flow chamber 104 (broadly, a second portion).

The accumulator portion 102 and heater portion 104 are divided or separated by a divider 106, which may comprise a membrane or diaphragm. In this exemplary embodiment, a flange 107 is used to hold or retain the divider 106.

In this illustrated embodiment, the assembly 100 includes a charge valve 108 for supplying (e.g., pumping, injecting, etc.) a pressurized fluid (e.g., nitrogen gas, etc.) into the interior of the accumulator portion 102. The addition of the pressurized fluid increases the pressure within the interior of the accumulator portion 102.

The walls of the accumulator portion 102 may be comprised of a metal (e.g., steel, etc.) or other material that does not substantially yield, bend, or deform in reaction to the pressurization and increased pressure within the accumulator portion 102 caused by the addition of the pressurizing fluid. The divider 106 may be a membrane or diaphragm comprised of a material that is flexible and substantially impermeable to the coolant and the pressurized pressurizing fluid. For example, the divider 106 may be made out of isobutyl isoprene rubber (IIR), ethylene propylene diene monomer rubber (EPDM), perfluoro-elastomers (FFKM), fluoroelastomers (FPM), nitrile rubber (NBR), polyvinyl chloride (PVC), other elastomers, etc.

The pressurization or increased pressure within the interior of the accumulator portion 102 may cause the divider 106 to flex, move, and/or deform in a direction generally away from the accumulator portion 102 and towards the heater portion 104 when the pressure within the accumulator portion 102 is higher than the pressure within the heater portion 104. The flexing of the divider 106 may cause or force the coolant within an interior of the heater portion 104 to exit the heater portion via the outlet 112. The flexing of the divider 106 may serve to substantially equalize the pressures within the accumulator portion 102 and the heater portion 104. The divider 106 may exert an amount of force and/or pressure based at least in part on the material of the divider 106 toward returning to an unflexed relaxed state, such that the pressures in the accumulator portion 102 and the heater portion 104 may not be exactly equalized by the flexing of the divider 106.

For the illustrated embodiment of FIG. 1, the accumulator portion 102 is pressurized by fluid supplied via the charge valve 108. Alternative embodiments may include an additional or different means or techniques for pressurizing the accumulator portion. For example, a spring or similar mechanism may be used to mechanically press or apply a mechanical spring force on the divider in order to flex, move, or deform the divider in other exemplary embodiments.

The assembly 100 includes an inlet 110 into the heater portion 104 and an outlet 112 out of the heater portion 104. As represented by the arrow 111, the inlet 110 allows coolant to enter an interior of the heater portion 104. The outlet 112 allows coolant to exit or be discharged from the interior of the heater portion 104 as represented by the arrow 113. The inlet and outlet 110, 112 thus enable a coolant flow through the heater portion 104 from the inlet 110 to the outlet 112. The locations of the inlet 110 and outlet 110 shown in FIG. 1 are examples only, as the inlet 110 and/or outlet 112 may be located at different locations in other exemplary embodiments. For example, another exemplary embodiment may include an inlet and outlet located on the same side of the assembly.

In addition, the assembly 100 may be configured to enable the coolant to traverse the length of the heater portion or flow chamber 104 one or more times, i.e., single pass flow or multiple pass flow. For example, FIGS. 4 through 12 illustrate another exemplary embodiment of a heater/accumulator assembly 200 configured for multiple pass flow such that the coolant may flow through the heater portion or coolant flow chamber 204 multiple times.

The assembly 100 may include a heat source (e.g., electric heater, etc.) operable for supplying heat for heating the coolant within the heater portion 104, such as when the coolant flows within the heater portion 104 between the inlet 110 and the outlet 112. In an exemplary embodiment, the heat source is an electric foil heater that may be disposed along and thermally coupled to (e.g., wrapped about, positioned against, etc.) an exterior surface 116 of the enclosure along the heater portion 104. The heat supplied by the electric foil heater may be transferred through the exterior of the enclosure to the coolant within the interior of the heater portion 104. Alternative embodiments may include one or more different types of heat source besides or in addition to an electric foil heater and/or one or more of the same or different types of heat sources located elsewhere, e.g., within an interior of the enclosure, etc.

Figure 2:
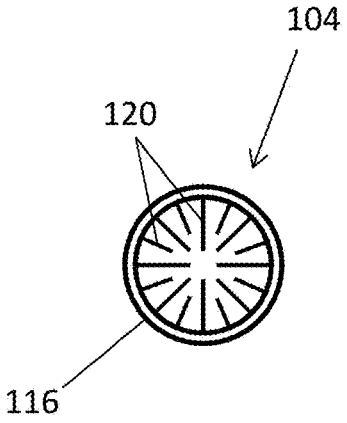
FIG. 2 is a cross-sectional view taken along the line A-A in FIG. 1, and showing the interior of the heater portion or coolant flow chamber (broadly, a second portion) of the enclosure of the heater/accumulator assembly.

FIG. 2 is a cross-sectional view taken along the line A-A in FIG. 1. FIG. 2 shows the interior of the heater portion 104 of the enclosure of the heater/accumulator assembly 100. As shown, fins 120 (broadly, surfaces) inwardly protrude from an inner surface of the enclosure along the heater portion 104 into the interior of the heater portion 104.

The protruding surfaces 120 are attached to or integral with (e.g., extruded from, etc.) the inner surface of the enclosure assembly 100 within heater portion 104. The surfaces 120 extend generally toward the center of the heater portion 104. Additionally, the protruding surfaces 120 may have variable lengths and be equally circumferentially spaced apart around the circumference of the interior surface of the heater portion 104. The protruding surfaces 120 provide additional surface area for contact with and for heat transfer to the coolant as the coolant flows through the heater portion 104. The surfaces 120 thus allow for more effective heating (or cooling) of the coolant. The protruding surfaces 120 may be heated via the heat source of the assembly 100 as heat may be transferred from the heat source to the exterior surface of the enclosure, through the material (e.g., steel, etc.) from which the enclosure is made, and to the protruding surfaces 120.

Alternative embodiments may include more, less, and/or differently configured protruding surfaces 120 than what is shown in FIG. 2. For example, other exemplary embodiments may include protruding surfaces in a variety of shapes (e.g., fins, cylinders, spikes, tubes, curves, etc.), sizes, and/or locations within the heater portion 104, whereby the surface area over which the coolant flows is increased by the presence of the protruding surfaces. Other exemplary embodiments may not include any protruding surfaces or fins 120.

Figure 3:
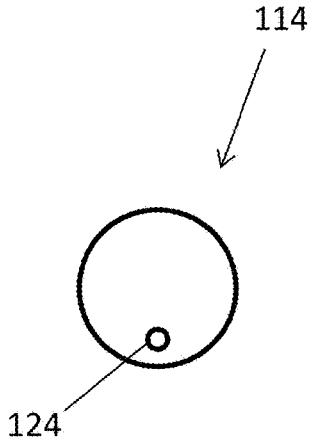
FIG. 3 is a cross-sectional view taken along the line B-B in FIG. 1, and showing a plate having a bleed hole, where the plate is positioned generally between the accumulator portion (broadly, a first portion) and the heater portion of the enclosure of the heater/accumulator assembly.

FIG. 3 is a cross-sectional view taken along the line B-B in FIG. 1. FIG. 3 shows a plate 114 having a bleed hole 124. The plate 114 is positioned generally between the heater portion 104 and the divider 106. The plate 114 may be located within or towards an end of the heater portion 104. The plate 114 may be configured such that the flow of the coolant from the inlet 110 to the outlet 112 is separated from the divider 106. The plate 114 may be made of the same, similar, or different material (e.g., steel, etc.) as the enclosure or body of the assembly 100. The plate 114 may be relatively rigid to resist deforming due to force or pressure exerted by flowing coolant within the heater portion 104 and/or to resist the force or pressure caused by the flexing, moving, and/or deforming of the divider 106. The plate 114 may be configured such that coolant flowing within the heater portion 104 does not apply or create pressure on the divider 106.

As shown in FIG. 3, the plate 114 includes a single bleed hole 124 located near a bottom edge of the plate 114. Alternatively, the plate 114 may include a single bleed hole 124 located elsewhere. The bleed hole 124 may be a variety of different shapes and/or sizes, both of which may be determined based on properties of the coolant. The bleed hole 124 enables pressure changes due to flexing and/or deforming of the divider 106 to be transmitted throughout the heater portion 104 while the plate 114 substantially prevents the divider 106 from being directly affected by the flow of the coolant through the heater portion 104. Alternatively, the plate 114 may include more than one bleed hole. For example, the plate 114 may include two or more bleed holes having the same or different sizes to facilitate coolant filling and removal of air bubbles from the assembly.

Referring again to FIG. 1, the heater portion 104 may occupy approximately three-fourths of the length and volume of the assembly 100, while the accumulator portion 102 may occupy approximately one-fourth of the length and volume of the enclosure assembly 100. In alternative embodiments, differently sized accumulator and heater portions and thus different size ratios may be used.

In some embodiments, the heater portion 104 and the accumulator portion 102 may be separate parts that are joined together at or adjacent the location of the divider 106. The divider 106 may include an O-ring or other suitable sealing member between the heater portion 104 and the accumulator portion 102 for forming a tight seal between the accumulator and heater portions 102, 104. The divider 106, when unflexed, may be configured to be generally perpendicular to and on a substantially perpendicular plane to the longitudinal axis of the assembly 100.

FIGS. 4 through 12 illustrate another exemplary embodiment of a heater/accumulator assembly 200 embodying one or more aspects of the present disclosure. The assembly 200 includes an enclosure (e.g., pressure vessel, pipe, tube, tank, housing, etc.) having an accumulator portion 202 (broadly, a first portion) and a heater portion or coolant flow chamber 204 (broadly, a second portion).

Figure 8:
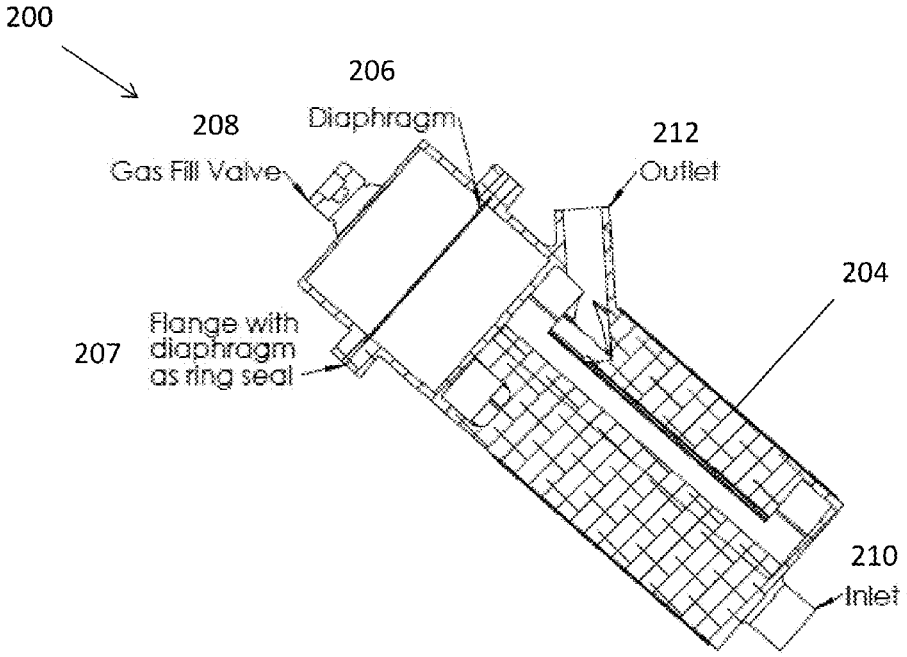
FIG. 8 is a cross-sectional view of the heater/accumulator assembly taken along the line A-A in FIG. 7, and showing the interior of the accumulator portion and the heater portion of the enclosure of the heater/accumulator assembly.
Figure 11:
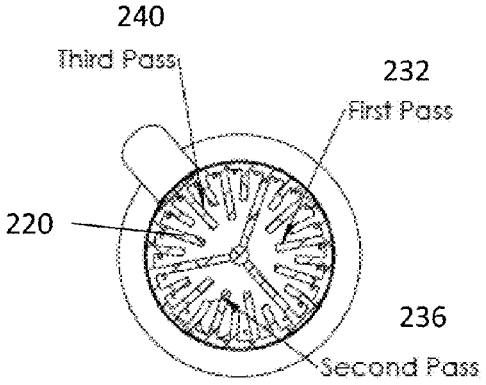
FIG. 11 is a cross-sectional view taken along the line C-C in FIG. 9, and showing first, second, and third passes for coolant flow within the interior of the heater portion of the enclosure of the heater/accumulator assembly.

The heater/accumulator assembly 200 may be similar to the heater/accumulator assembly 100 shown in FIG. 1 and described above. But as shown in FIGS. 8 and 11, this exemplary embodiment of the heater/accumulator assembly 200 is configured for multiple pass flow such that coolant may traverse the length of the heater portion or coolant flow chamber 204 multiple times. FIG. 11 shows a first pass 232, a second pass 236, and a third pass 240 for coolant flow within the interior of the heater portion 204 of the enclosure of the heater/accumulator assembly 200.

The accumulator portion 202 and heater portion 204 are divided or separated by a divider 206, which may comprise a membrane or diaphragm. As shown in FIG. 8, this exemplary embodiment includes a flange 207 with the diaphragm 206 as ring seal.

The assembly 200 includes a charge valve 208 for supplying (e.g., pumping, injecting, etc.) a pressurized fluid (e.g., nitrogen gas, etc.) into the interior of the accumulator portion 202. The addition of the pressurized fluid increases the pressure within the interior of the accumulator portion 202. Alternative embodiments may include an additional or different means or techniques for pressurizing the accumulator portion. For example, a spring or similar mechanism may be used to mechanically press or apply a mechanical spring force on the divider in order to flex, move, or deform the divider in other exemplary embodiments.

The pressurization or increased pressure within the interior of the accumulator portion 202 may cause the divider 206 to flex, move, and/or deform in a direction generally away from the accumulator portion 202 and towards the heater portion 204 when the pressure within the accumulator portion 202 is higher than the pressure within the heater portion 204. The flexing of the divider 206 may cause or force the coolant within an interior of the heater portion 204 to exit the heater portion via the outlet 212. The flexing of the divider 206 may serve to substantially equalize the pressures within the accumulator portion 202 and the heater portion 204. The divider 206 may exert an amount of force and/or pressure based at least in part on the material of the divider 206 toward returning to an unflexed relaxed state, such that the pressures in the accumulator portion 202 and the heater portion 204 may not be exactly equalized by the flexing of the divider 206.

Figure 4:
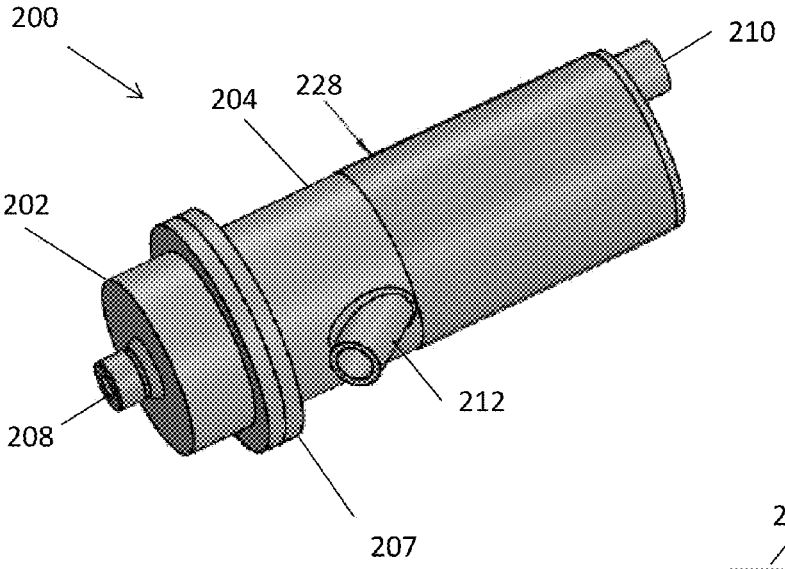
FIG. 4 is a perspective view of a heater/accumulator assembly according to another exemplary embodiment, and showing a heater element applied about an exterior surface of the enclosure along the heater portion.
Figure 5:
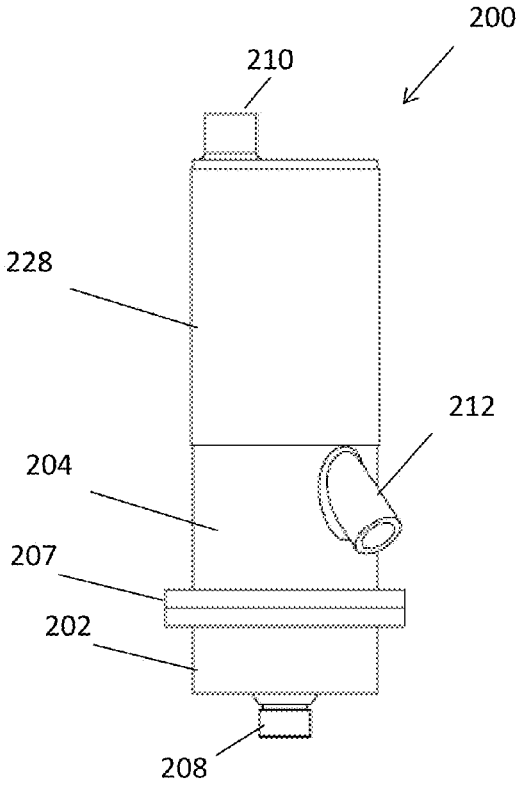
FIG. 5 is a side view of the heater/accumulator assembly shown in FIG. 4.
Figure 6:
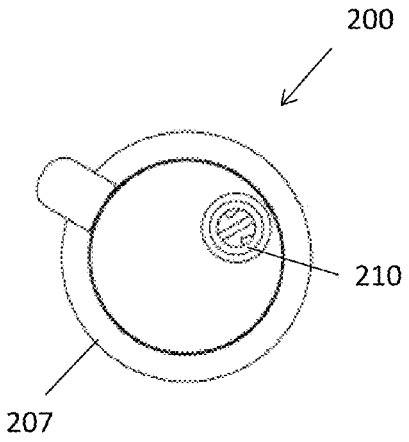
FIG. 6 is a top view of the heater/accumulator assembly shown in FIG. 4; and showing the inlet of the heater/accumulator assembly.
Figure 7:
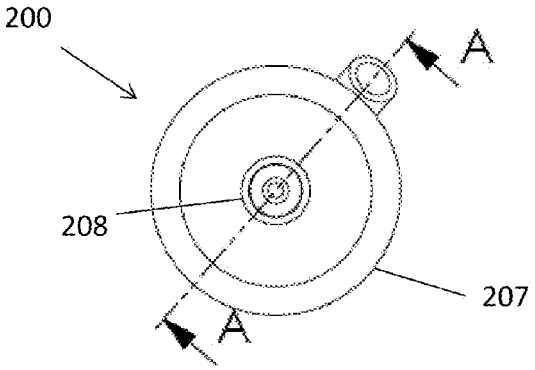
FIG. 7 is a bottom view of the heater/accumulator assembly shown in FIG. 4, and showing a gas fill valve and an outlet of the heater/accumulator assembly.

The assembly 200 includes an inlet 210 into the heater portion 204 and an outlet 212 out of the heater portion 204. The inlet 210 allows coolant to enter the interior of the heater portion 204. The outlet 212 allows coolant to exit or be discharged from the interior of the heater portion 204. Accordingly, coolant may enter the interior of the heater portion 204 via the inlet 210, flow through the first, second, and third passes 232, 236, and 240, and then be discharged via the outlet 212. The locations of the inlet 210 and outlet 212 shown in FIG. 4 are examples only, as the inlet 210 and/or outlet 212 may be located at different locations in other exemplary embodiments. For example, another exemplary embodiment may include an inlet and outlet located on the same side of the assembly.

The assembly 200 also includes a heat source 228 operable for supplying heat for heating the coolant within the heater portion 204, such as when the coolant flows or traverses multiple times across a length of the interior of the heater portion 204. In this exemplary embodiment, the heat source 228 is an electric foil heater (e.g., 1 kilowatt heater element, etc.) wrapped about the exterior surface of the enclosure along the heater portion 204. The heat supplied by the electric foil heater may be transferred through the exterior of the enclosure to the coolant within the interior of the heater portion 204. Alternative embodiments may include one or more different types of heat source besides or in addition to an electric foil heater and/or one or more of the same or different types of heat sources located elsewhere, e.g., within an interior of the enclosure, etc.

Figure 9:
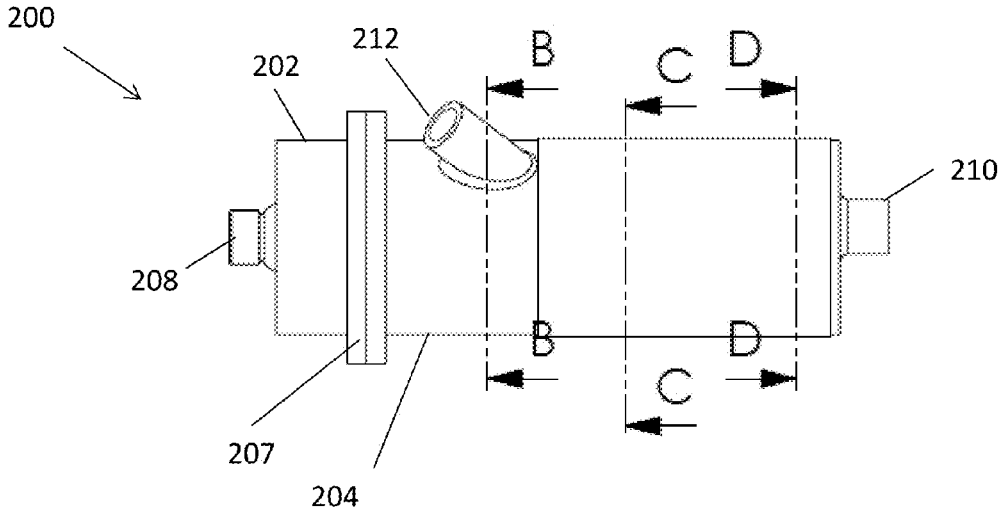
FIG. 9 is another side view of the heater/accumulator assembly shown in FIG. 4.
Figure 10:
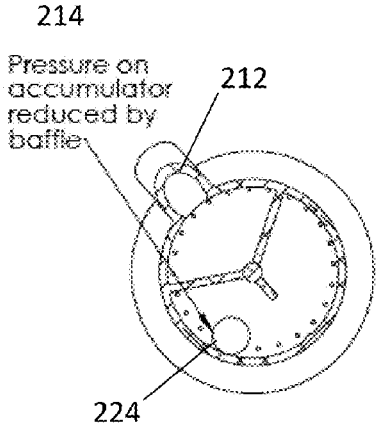
FIG. 10 is a cross-sectional view taken along the line B-B in FIG. 9, and showing a baffle for reducing pressure on the accumulator portion of the heater/accumulator assembly.

FIG. 10 is a cross-sectional view taken along the line B-B in FIG. 9. FIG. 10 shows a baffle or plate 214 for reducing pressure on the accumulator portion 202 of the heater/accumulator assembly 200. The baffle 214 includes a bleed hole 224. The baffle 214 is positioned generally between the heater portion 204 and the divider 206. The baffle 214 may be located within or towards an end of the heater portion 204. The baffle 214 may be configured such that the coolant flow within the heater portion 204 is separated from the divider 206. The baffle 214 may be made of the same, similar, or different material (e.g., steel, etc.) as the enclosure or body of the assembly 200. The baffle 214 may be relatively rigid to resist deforming due to force or pressure exerted by flowing coolant within the heater portion 204 and/or to resist the force or pressure caused by the flexing, moving, and/or deforming of the divider 206. The baffle 214 may be configured such that coolant flowing within the heater portion 204 does not apply or create pressure on the divider 206.

As shown in FIG. 10, the baffle 214 includes a single bleed hole 224 located near a bottom edge of the baffle 214. Alternatively, the baffle 214 may include a single bleed hole 224 located elsewhere. The bleed hole 224 may be a variety of different shapes and/or sizes, both of which may be determined based on properties of the coolant. The bleed hole 224 enables pressure changes due to flexing and/or deforming of the divider 206 to be transmitted throughout the heater portion 204 while the baffle 214 substantially prevents the divider 206 from being directly affected by the flow of the coolant through the heater portion 204. Alternatively, the baffle 214 may include more than one bleed hole. For example, the baffle 214 may include two or more bleed holes having the same or different sizes to facilitate coolant filling and removal of air bubbles from the assembly.

FIG. 11 is a cross-sectional view taken along the line C-C in FIG. 9. FIG. 11 shows the first, second, and third passes 232, 236, 240 for coolant flow within the interior of the heater portion 204 of the enclosure of the heater/accumulator assembly 200. FIG. 11 also shows fins 220 (broadly, surfaces) that protrude inwardly from an inner surface of the enclosure along the heater portion 204 into the interior of the heater portion 204.

The protruding surfaces 220 are attached to or integral with (e.g., extruded from, etc.) the inner surface of the enclosure assembly 200 within heater portion 204. The surfaces 220 extend generally toward the center of the heater portion 204. The protruding surfaces 220 may have variable lengths and may be equally circumferentially spaced apart around the circumference of the interior surface of the heater portion 204. The protruding surfaces 220 provide additional surface area for contact with and for heat transfer to the coolant. The surfaces 220 thus allow for more effective heating (or cooling) of the coolant. The protruding surfaces 220 may be heated via the heat source 228 of the assembly 200 as heat may be transferred from the heat source 228 to the exterior surface of the enclosure, through the material (e.g., steel, etc.) from which the enclosure is made, and to the protruding surfaces 220.

Alternative embodiments may include more, less, and/or differently configured protruding surfaces 220 than what is shown in FIG. 11. For example, other exemplary embodiments may include protruding surfaces in a variety of shapes (e.g., fins, cylinders, spikes, tubes, curves, etc.), sizes, and/or locations within the heater portion 204, whereby the surface area over which the coolant flows is increased by the presence of the protruding surfaces. Other exemplary embodiments may not include any protruding surfaces or fins 220.

Figure 12:
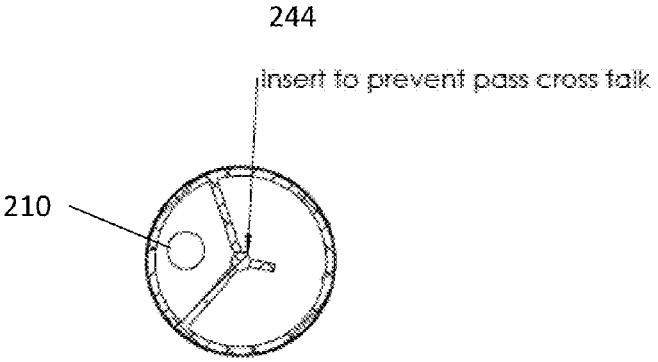
FIG. 12 is a cross-sectional view taken along the line D-D in FIG. 9, and showing an insert for inhibiting or preventing pass cross talk.

FIG. 12 is a cross-sectional view taken along the line D-D in FIG. 9. FIG. 12 shows an insert 244 for inhibiting (e.g., reducing or preventing, etc.) pass cross talk.

FIGS. 13 through 19 illustrate another exemplary embodiment of a heater/accumulator assembly 300 embodying one or more aspects of the present disclosure. The assembly 300 includes an enclosure (e.g., pressure vessel, pipe, tube, tank, housing, etc.) having an accumulator portion 302 (broadly, a first portion) and a heater portion or coolant flow chamber 304 (broadly, a second portion).

The heater/accumulator assembly 300 may be similar to the heater/accumulator assembly 200 shown in FIGS. 4 through 12 and described above. But as shown in FIGS. 13, 16, and 17, this exemplary embodiment of the heater/accumulator assembly 300 does not include the external flange 207. Instead, the heater heater/accumulator assembly 300 includes internal flanges or wall portions 307 for holding the divider 306 as shown in FIG. 17.

The heater/accumulator assembly 300 is also configured for multiple pass flow such that coolant may traverse the length of the heater portion or coolant flow chamber 304 multiple times. FIG. 19 shows a first pass 332, a second pass 336, and a third pass 340 for coolant flow within the interior of the heater portion 304 of the enclosure of the heater/accumulator assembly 300.

As shown in FIGS. 16 and 17, the accumulator portion 302 and heater portion 304 are divided or separated by a divider 306, which may comprise a membrane or diaphragm. The assembly 300 includes a charge valve 308 for supplying (e.g., pumping, injecting, etc.) a pressurized fluid (e.g., nitrogen gas, etc.) into the interior of the accumulator portion 302. The addition of the pressurized fluid increases the pressure within the interior of the accumulator portion 302. Alternative embodiments may include an additional or different means or techniques for pressurizing the accumulator portion. For example, a spring or similar mechanism may be used to mechanically press or apply a mechanical spring force on the divider in order to flex, move, or deform the divider in other exemplary embodiments.

The pressurization or increased pressure within the interior of the accumulator portion 302 may cause the divider 306 to flex, move, and/or deform in a direction generally away from the accumulator portion 302 and towards the heater portion 304 when the pressure within the accumulator portion 302 is higher than the pressure within the heater portion 304. The flexing of the divider 306 may cause or force the coolant within an interior of the heater portion 304 to exit the heater portion via the outlet 312. The flexing of the divider 306 may serve to substantially equalize the pressures within the accumulator portion 302 and the heater portion 304. The divider 306 may exert an amount of force and/or pressure based at least in part on the material of the divider 306 toward returning to an unflexed relaxed state, such that the pressures in the accumulator portion 302 and the heater portion 304 may not be exactly equalized by the flexing of the divider 306.

The assembly 300 includes an inlet 310 into the heater portion 304 and an outlet 312 out of the heater portion 304. The inlet 310 allows coolant to enter the interior of the heater portion 304. The outlet 312 allows coolant to exit or be discharged from the interior of the heater portion 304. Accordingly, coolant may enter the interior of the heater portion 304 via the inlet 310, flow through the first, second, and third passes 332, 336, and 340, and then be discharged via the outlet 312. The locations of the inlet 310 and outlet 312 shown in FIGS. 13 and 15 are examples only, as the inlet 310 and/or outlet 312 may be located at different locations in other exemplary embodiments. For example, another exemplary embodiment may include an inlet and outlet located on the same side of the assembly.

The assembly 300 also includes a heat source 328 operable for supplying heat for heating the coolant within the heater portion 304, such as when the coolant flows or traverses multiple times across a length of the interior of the heater portion 304. In this exemplary embodiment, the heat source 328 is an electric foil heater (e.g., 1 kilowatt heater element, etc.) wrapped about the exterior surface of the enclosure along the heater portion 304. The heat supplied by the electric foil heater may be transferred through the exterior of the enclosure to the coolant within the interior of the heater portion 304. Alternative embodiments may include one or more different types of heat source besides or in addition to an electric foil heater and/or one or more of the same or different types of heat sources located elsewhere, e.g., within an interior of the enclosure, etc.

FIG. 19 is a cross-sectional view taken along the line F-F in FIG. 18. FIG. 11 shows fins 320 (broadly, surfaces) that protrude inwardly from an inner surface of the enclosure along the heater portion 304 into the interior of the heater portion 304. The protruding surfaces 320 are attached to or integral with (e.g., extruded from, etc.) the inner surface of the enclosure assembly 300 within heater portion 304. The surfaces 320 extend generally toward the center of the heater portion 304. The protruding surfaces 320 may have variable lengths and may be equally circumferentially spaced apart around the circumference of the interior surface of the heater portion 304. The protruding surfaces 320 provide additional surface area for contact with and for heat transfer to the coolant. The surfaces 320 thus allow for more effective heating (or cooling) of the coolant. The protruding surfaces 320 may be heated via the heat source 328 of the assembly 300 as heat may be transferred from the heat source 328 to the exterior surface of the enclosure, through the material (e.g., steel, etc.) from which the enclosure is made, and to the protruding surfaces 320.

Alternative embodiments may include more, less, and/or differently configured protruding surfaces 320 than what is shown in FIG. 19. For example, other exemplary embodiments may include protruding surfaces in a variety of shapes (e.g., fins, cylinders, spikes, tubes, curves, etc.), sizes, and/or locations within the heater portion 304, whereby the surface area over which the coolant flows is increased by the presence of the protruding surfaces. Other exemplary embodiments may not include any protruding surfaces or fins 320.

The heater/accumulator 300 may also include a baffle or plate for reducing pressure on the accumulator portion 302 of the heater/accumulator assembly 300. The baffle may include one or more bleed holes. The baffle may be positioned generally between the heater portion 304 and the divider 306. The baffle may be located within or towards an end of the heater portion 304. The baffle may be configured such that the coolant flow within the heater portion 304 is separated from the divider 306. The baffle may be made of the same, similar, or different material (e.g., steel, etc.) as the enclosure or body of the assembly 300. The baffle may be relatively rigid to resist deforming due to force or pressure exerted by flowing coolant within the heater portion 304 and/or to resist the force or pressure caused by the flexing, moving, and/or deforming of the divider 306. The baffle may be configured such that coolant flowing within the heater portion 304 does not apply or create pressure on the divider 306.

FIGS. 20 through 26 illustrate another exemplary embodiment of a heater/accumulator assembly 400 embodying one or more aspects of the present disclosure. The assembly 400 includes an enclosure (e.g., pressure vessel, pipe, tube, tank, housing, etc.) having an accumulator portion 402 (broadly, a first portion) and a heater portion or coolant flow chamber 404 (broadly, a second portion).

The heater/accumulator assembly 400 is configured for multiple pass flow such that coolant may traverse the length of the heater portion or coolant flow chamber 404 multiple times. In addition, this exemplary embodiment has a symmetric design such that either port 410 or 412 may be used as the inlet or the outlet. For example, the port 410 may be used as the inlet and allow coolant to enter the interior of the heater portion 404, and the other port 412 may then be used as the outlet to allow coolant to exit or be discharged from the interior of the heater portion 404. Alternatively, the port 412 may be used as the inlet and allow coolant to enter the interior of the heater portion 404, and the other port 410 may then be used as the outlet to allow coolant to exit or be discharged from the interior of the heater portion 404. Accordingly, coolant may enter the interior of the heater portion 404 via the port 410 or 412, flow through the passes (FIG. 23), and then be discharged via the other portion 410 or 412. The locations of the ports 410 and outlet 412 shown in FIG. 20 are examples only, as the ports 410 and/or outlet 412 may be located at different locations in other exemplary embodiments.

The accumulator portion 402 and heater portion 404 are divided or separated by a divider 406, which may comprise a membrane or diaphragm. As shown in FIGS. 24 and 26, this exemplary embodiment includes a circular diaphragm 406 that is held or retained via the flange 407.

The assembly 400 includes a charge valve 408 for supplying (e.g., pumping, injecting, etc.) a pressurized fluid (e.g., nitrogen gas, etc.) into the interior of the accumulator portion 402. The addition of the pressurized fluid increases the pressure within the interior of the accumulator portion 402. Alternative embodiments may include an additional or different means or techniques for pressurizing the accumulator portion. For example, a spring or similar mechanism may be used to mechanically press or apply a mechanical spring force on the divider in order to flex, move, or deform the divider in other exemplary embodiments.

The pressurization or increased pressure within the interior of the accumulator portion 402 may cause the divider 406 to flex, move, and/or deform in a direction generally away from the accumulator portion 402 and towards the heater portion 404 when the pressure within the accumulator portion 402 is higher than the pressure within the heater portion 404. The flexing of the divider 406 may cause or force the coolant within an interior of the heater portion 404 to exit the heater portion via the outlet 412. The flexing of the divider 406 may serve to substantially equalize the pressures within the accumulator portion 402 and the heater portion 404. The divider 406 may exert an amount of force and/or pressure based at least in part on the material of the divider 406 toward returning to an unflexed relaxed state, such that the pressures in the accumulator portion 402 and the heater portion 404 may not be exactly equalized by the flexing of the divider 406.

The assembly 400 also includes a heat source 428 operable for supplying heat for heating the coolant within the heater portion 404, such as when the coolant flows or traverses multiple times across a length of the interior of the heater portion 404. In this exemplary embodiment, the heat source 428 comprises four rectangular heaters (e.g., summing to 1 kilowatt, etc.) each applied externally to a different one of the four side surfaces of the heater portion 204. The heat supplied by the four heaters may be transferred through the exterior of the enclosure to the coolant within the interior of the heater portion 404. Alternative embodiments may include one or more different types of heat source besides or in addition to four rectangular heaters and/or one or more of the same or different types of heat sources located elsewhere, e.g., within an interior of the enclosure, etc.

FIG. 23 is a cross-sectional view of the heater/accumulator assembly 400 taken along the line A-A in FIG. 20. FIG. 23 shows an insert 448 for channeling coolant flow through fins 420 (broadly, surfaces) within the interior of the heater portion 404 of the enclosure of the heater/accumulator assembly 400. The fins 420 protrude inwardly from an inner surface of the enclosure along the heater portion 404 into the interior of the heater portion 404.

The protruding surfaces 420 are attached to or integral with (e.g., extruded from, etc.) the inner surface of the enclosure assembly 400 within heater portion 404. The surfaces 420 extend generally toward the center of the heater portion 404. The protruding surfaces 420 may have variable lengths and may be spaced apart around the perimeter of the interior surface of the heater portion 404. The protruding surfaces 420 provide additional surface area for contact with and for heat transfer to the coolant. The surfaces 420 thus allow for more effective heating (or cooling) of the coolant. The protruding surfaces 420 may be heated via the heat source 428 of the assembly 400 as heat may be transferred from the heat source 428 to the exterior surface of the enclosure, through the material (e.g., steel, etc.) from which the enclosure is made, and to the protruding surfaces 420.

Alternative embodiments may include more, less, and/or differently configured protruding surfaces 420 than what is shown in FIG. 23. For example, other exemplary embodiments may include protruding surfaces in a variety of shapes (e.g., fins, cylinders, spikes, tubes, curves, etc.), sizes, and/or locations within the heater portion 404, whereby the surface area over which the coolant flows is increased by the presence of the protruding surfaces. Other exemplary embodiments may not include any protruding surfaces or fins 420.

FIG. 25 is a cross-sectional view of the heater/accumulator assembly taken along the line B-B in FIG. 24. FIG. 25 shows a baffle or plate 414 for channeling flow between the passes through fins 420 (FIG. 23) within the interior of the heater portion 404 of the enclosure of the heater/accumulator assembly 400. The baffle 414 may also reduce pressure on the accumulator portion 402 of the heater/accumulator assembly 400. The baffle 414 may include one or more bleed holes as disclosed herein for other exemplary embodiments. The baffle 414 is located within or towards an end of the heater portion 404. The baffle 414 may be configured such that the coolant flow within the heater portion 404 is separated from the divider 406. The baffle 414 may be made of the same, similar, or different material (e.g., steel, etc.) as the enclosure or body of the assembly 400. The baffle 414 may be relatively rigid to resist deforming due to force or pressure exerted by flowing coolant within the heater portion 404 and/or to resist the force or pressure caused by the flexing, moving, and/or deforming of the divider 406. The baffle 414 may be configured such that coolant flowing within the heater portion 404 does not apply or create pressure on the divider 406.

In this exemplary embodiment, the enclosure of the heater/accumulator assembly 400 has a generally square cross-sectional shape. Alternative embodiments may include an enclosure having a different cross-sectional shape, such as circular, rectangular, non-rectangular, etc.

In addition to the features shown in the figures, additional features may be present in exemplary embodiments of the heater/accumulator assemblies, such as one or more sensors, etc. For example, one or more sensors may be included for measuring one or more of membrane distance, temperature, pressure, level, dielectricity or conductivity, coolant flow, etc.

In exemplary embodiments, an assembly may comprise an enclosure including a first portion (or accumulator portion), a second portion (or heater portion or coolant flow chamber), and a divider (or membrane or diaphragm) between the first and second portions. The assembly may also include an inlet through which coolant may enter an interior of the second portion, and an outlet through which the coolant may exit the interior of the second portion. The assembly may further include a heat source operable for supplying heat for heating the coolant within the interior of the second portion.

The assembly may be a single, integrated unit operable as an accumulator and a heater. The first portion and the divider may be operable as the accumulator for pressurizing the enclosure. The heat source and the second portion may be operable as the heater for heating the coolant as the coolant is within the interior of the second portion and/or flows through the interior of the second portion of the enclosure from the inlet to the outlet (e.g., as the coolant traverses a length of the interior of the second portion a single time (single pass flow) or multiple times (multiple pass flow), etc.).

The divider may comprise a diaphragm. In which case, the diaphragm and the first portion of the enclosure may be operable as a diaphragm accumulator.

The assembly may include a charge valve operable for supplying a pressurized fluid (e.g., air, nitrogen gas, liquid, other fluid, etc.) into the interior of the first portion to thereby pressurize the first portion and cause the divider to flex, move, or deform in a direction from the first portion to the second portion. This, in turn, may cause or force coolant within the second portion to be discharged from the interior of the second portion via the outlet. Alternatively or additionally, a mechanism may be used for applying a mechanical force to the divider and cause coolant within the second portion to be discharged from the interior of the second portion via the outlet. For example, a spring mechanism may be used that is operable for applying a mechanical spring force to pressure the divider and cause coolant to exit the interior of the second portion via the outlet.

One or more surfaces may protrude inwardly from an inner surface of the enclosure along the second portion into the interior of the second portion, such that heat is transferrable from the one or more surfaces to the coolant within the interior of the second portion. For example, heat may be transferred from the one or more surfaces to the coolant as the coolant flows across the one or more surfaces through the interior of the second portion. The one or more surfaces may comprise a plurality of extruded fins that protrude inwardly from the inner surface of the enclosure towards a center of the interior of the second portion.

The heat source may comprise one or more heat sources within the interior of the second portion and/or one or more heat sources disposed along and thermally coupled to an exterior surface of the enclosure along the second portion. For example, the heat source may comprise an electric foil heater disposed along (e.g., wrapped around, etc.) and thermally coupled to an exterior surface of the enclosure and the plurality of fins. The heat from the electric foil heater may be transferrable to the coolant as the coolant flows across the plurality of fins and through the interior of the second portion from the inlet to the outlet. As another example, one or more heaters (e.g., four heaters summing to 1 kilowatt, etc.) may be disposed along an exterior surface of each side of the enclosure along the second portion.

The assembly may include a plate between the second portion and the divider. The plate may have one or more bleed holes. The plate may be operable for preventing application of pressure on the divider from the coolant flow through the interior of the second portion.

The enclosure may comprise a cylindrical tubular housing including a longitudinal axis, a first section defining the first portion, and a second section coupled to the first section and defining the second portion. The divider may include an O-ring between the first and second sections of the cylindrical tubular housing. The divider may be generally perpendicular to the longitudinal axis when the first portion is unpressurized. The divider may be positioned within the enclosure such that the first portion extends along about one-fourth of a length of the enclosure and such that the second portion extends along about three-fourths of the length of the enclosure.

A system (e.g., cooling system, closed liquid circuit, etc.) may include the assembly and a source of pressurized fluid for supplying pressurized fluid into the interior of the first portion. The divider may be impermeable to the coolant and the pressurized fluid such that the divider prevents the pressurized fluid from flowing from the first portion into the second portion and prevents the coolant from flowing from the second portion into the first portion.

In an exemplary embodiment, a method may generally include applying pressure to a membrane between first and second compartments of a heater-accumulator assembly such that the membrane flexes or moves in a direction from the first compartment towards the second compartment. The method may also include heating coolant within an interior of the second compartment. The membrane may prevent the coolant from flowing from the second compartment into the first compartment.

Applying pressure to the membrane may include supplying a pressurized fluid into an interior of the first compartment of the heater-accumulator assembly. The membrane may prevent the pressurized fluid from flowing from the first compartment into the second compartment. Applying pressure to the membrane may cause the coolant within the interior of the second compartment to exit the interior of the second compartment via an outlet.

In exemplary embodiments disclosed herein, the walls of the accumulator portion may be comprised of a metal (e.g., steel, etc.) or other material that does not substantially yield, bend, or deform in reaction to the pressurization and increased pressure within the accumulator portion caused by the addition of the pressurizing fluid. The divider may be a membrane or diaphragm comprised of a material that is flexible and substantially impermeable to the coolant and the pressurized pressurizing fluid. For example, the divider may be made out of isobutyl isoprene rubber (IIR), ethylene propylene diene monomer rubber (EPDM), perfluoro-elastomers (FFKM), fluoroelastomers (FPM), nitrile rubber (NBR), polyvinyl chloride (PVC), other elastomers, etc.

The assemblies and features thereof disclosed herein including the accumulator portion, the heater portion, the divider, etc., may be any suitable size (e.g., height, diameter, etc.). The size of a feature/assembly may be determined based on particular specifications, desired results, etc. For example, the size and/or shape of the enclosure disclosed herein may be determined so that a particular type of coolant and/or pressurized fluid may be used.

Additionally, the shape of the features of the assemblies disclosed herein may be any suitable shape. For example, the charge valve, inlet, outlet, divider, fins, etc. may be square, rectangular, oval, circular, pentagonal, etc., depending on manufacturability of a shape, cost effectiveness, particular specifications, desired results, etc. Further, although the assemblies disclosed herein are shown to include one inlet, one outlet, one charge valve, and one divider, etc., any number of these features may be employed without departing from the present disclosure. For example, an assembly may include more than one inlet, more than one outlet, more than one divider, etc.

Exemplary embodiments of the heater/accumulator assemblies disclosed herein may be suitable for a wide range of applications for heating and/or cooling coolant fluids. For example, an exemplary embodiment of a heater/accumulator assembly may be used for controlling a temperature of a cooling system to a set point. In above ambient air set point systems, this may be accomplished by controlling cooling fans and the heater on the accumulator. In below ambient systems, this may be accomplished with the help of cooling provided by thermoelectrics and/or a refrigeration system. Additionally, an exemplary embodiment of a heater/accumulator assembly may be used to bring a cooling system up to a certain temperature (cold start). In this latter case, it would not be a temperature control application. Exemplary embodiments of the heater/accumulator assemblies may be used in medical imaging cooling systems (e.g., a CT (computed tomography) detector temperature control system, etc.), laser cooling systems, semiconductor tool cooling systems, industrial frequency converter cooling systems (drives), transformer cooling systems, cooling systems for analytical, pharmaceutical and diagnostic instruments, etc. Exemplary embodiments of heater/accumulator assemblies disclosed herein may be implemented in a wide variety of different cooling or heating systems, and should not be limited to any one particular end use.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific numerical dimensions and values, specific materials, and/or specific shapes disclosed herein are exemplary in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "includes," "including," "has," "have," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An assembly comprising:

an enclosure including a first portion, a second portion, and a divider between the first and second portions;

an inlet through which a coolant may enter an interior of the second portion;

an outlet through which the coolant may exit the interior of the second portion;

a heat source operable for supplying heat for heating the coolant within the interior of the second portion;

a baffle having one or more bleed holes, wherein the baffle is positioned generally between the divider and the second portion of the enclosure, the baffle configured to be operable for at least reducing application of pressure on the divider from the coolant flowing within the interior of the second portion;

the divider is flexible, movable, and/or deformable in a direction away from the first portion towards the second portion for causing the coolant within the interior of the second portion to exit the interior of the second portion via the outlet; and whereby the assembly is configured to allow pressurizing of an interior of the first portion to thereby cause the divider to flex, move, and/or deform in the direction away from the first portion towards the second portion for causing coolant to exit the interior of the second portion via the outlet; and whereby the one or more bleed holes are configured to enable pressure changes due to flexing, moving, and/or deforming of the divider to be transmitted throughout the second portion while the baffle at least inhibits the divider from being directly affected by the flow of coolant through the second portion; and wherein:

the assembly includes first and second ports and a symmetric design such that either the first port and the second port are usable as the inlet or the outlet; and/or the baffle comprises a plate having the one or more bleed holes, the plate configured to resist deforming due to force or pressure exerted by flowing coolant within the second portion and to resist the force or pressure caused by the flexing, moving, and/or deforming of the divider, whereby the plate is operable for at least reducing application of pressure on the divider from the coolant flowing within the interior of the second portion.

2. The assembly of claim 1, wherein the assembly is a single integrated unit for a closed liquid circuit and operable as both a heater for the coolant and an accumulator for mitigating volume changes of the coolant due to temperature changes of the coolant.

3. The assembly of claim 1, wherein the divider comprises a diaphragm such that the diaphragm and the first portion of the enclosure are operable as a diaphragm accumulator.

4. The assembly of claim 1, wherein the assembly includes a charge valve operable for supplying a pressurized gas into the interior of the first portion to pressurize the first portion and thereby cause the divider to flex, move, and/or deform in the direction away from the first portion and towards the second portion for causing the coolant within the interior of the second portion to exit the interior of the second portion via the outlet.

5. The assembly of claim 1, wherein the assembly includes a mechanism operable for applying a mechanical force to the divider to flex, move, and/or deform the divider in the direction away from the first portion and towards the second portion and cause coolant within the interior of the second portion to exit the interior of the second portion via the outlet.

6. The assembly of claim 1, wherein the assembly further comprises one or more surfaces that protrude inwardly from an inner surface of the enclosure along the second portion into the interior of the second portion such that heat is transferrable from the one or more surfaces to the coolant within the interior of the second portion.

7. The assembly of claim 1, wherein the assembly is configured for multiple pass flow of the coolant through the second portion to enable the coolant to traverse a length of the interior of the second portion at least three times including a first pass, a second pass, and a third pass of the coolant flow within the second portion.

8. The assembly of claim 1, wherein the heat source comprises:

one or more heat sources within the interior of the second portion; and/or one or more heat sources disposed along and thermally coupled to an exterior surface of the enclosure along the second portion.

9. The assembly of claim 1, wherein:

a plurality of fins inwardly protrude from an inner surface of the enclosure along the second portion into the interior of the second portion;

the fins are spaced apart around a perimeter of the inner surface of the enclosure of the second portion; and the heat source comprises an electric foil heater disposed along and thermally coupled to an exterior surface of the enclosure along the second portion;

whereby the electric foil heater is operable for supplying heat for heating the exterior surface of the enclosure and the plurality of fins, which heat is transferrable to the coolant as the coolant flows across the plurality of fins.

10. The assembly of claim 1, wherein:

the enclosure comprises a cylindrical tubular housing including a longitudinal axis, a first section defining the first portion, and a second section coupled to the first section and defining the second portion, the divider includes an O-ring between the first and second sections of the cylindrical tubular housing, and the divider is generally perpendicular to the longitudinal axis when the first portion is unpressurized; and/or the divider is positioned within the enclosure such that the first portion extends along about one-fourth of a length of the enclosure and such that the second portion extends along about three-fourths of the length of the enclosure.

11. A system comprising the assembly of claim 1 and a source of pressurized fluid for supplying pressurized fluid into the interior of the first portion, to thereby cause the divider to flex, move, and/or deform in the direction away from the first portion and towards the second portion for causing the coolant within the interior of the second portion to exit the interior of the second portion via the outlet.

12. A heater-accumulator assembly comprising:

an enclosure including an accumulator portion, a heater portion, and a membrane between the accumulator portion and the heater portion;

an inlet through which coolant may enter an interior of the heater portion;

an outlet through which the coolant may exit the interior of the heater portion; and a heat source operable for supplying heat for heating the coolant with the interior of the heater portion;

a baffle having one or more bleed holes, wherein the baffle is positioned generally between the membrane and the heater portion of the enclosure, the baffle configured to be operable for at least reducing application of pressure on the membrane from the coolant flowing within the interior of the heater portion;

whereby the membrane is flexible, movable, and/or deformable in a direction away from the accumulator portion and towards the heater portion for causing the coolant within the interior of the heater portion to exit the interior of the heater portion via the outlet; and wherein:

the assembly includes first and second ports and a symmetric design such that either the first port and the second port are usable as the inlet or the outlet; and/or the baffle comprises a plate having the one or more bleed holes, the plate configured to resist deforming due to force or pressure exerted by flowing coolant within the second portion and to resist the force or pressure caused by the flexing, moving, and/or deforming of the membrane, the one or more bleed holes configured to enable pressure changes due to flexing, moving, and/or deforming of the membrane to be transmitted throughout the heater portion, whereby the plate is operable for at least reducing application of pressure on the membrane from the coolant flowing within the interior of the heater portion.

13. The assembly of claim 12, wherein the assembly is a single integrated unit for a closed liquid circuit and operable as both a heater for the coolant and an accumulator for mitigating volume changes of the coolant due to temperature changes of the coolant.

14. The assembly of claim 12, further comprising a charge valve operable for supplying a pressurized gas into the interior of the accumulator portion to pressurize the accumulator portion and thereby cause the membrane to flex, move, and/or deform in the direction away from the accumulator portion and towards the heater portion for causing the coolant within the interior of the heater portion to exit the interior of the heater portion via the outlet.

15. The assembly of claim 12, wherein the assembly includes a mechanism operable for applying a mechanical force to the membrane to flex, move, and/or deform the membrane in the direction away from the accumulate portion and towards the heater portion and cause coolant within the interior of the heater portion to exit the interior of the heater portion via the outlet.

16. The assembly of claim 12, wherein the assembly is configured for multiple pass flow of the coolant through the heater portion to enable the coolant to traverse a length of the interior of the heater portion at least three times including a first pass, a second pass, and a third pass of the coolant flow within the heater portion.

17. The assembly of claim 12, wherein the heat source comprises:

one or more heat sources within the interior of the heater portion; and/or one or more heat sources disposed along and thermally coupled to an exterior surface of the enclosure along the heater portion.

18. The assembly of claim 12, wherein:

a plurality of fins inwardly protrude from an inner surface of the enclosure along the heater portion into the interior of the heater portion;

the fins are spaced apart around a perimeter of the inner surface of the enclosure along the heater portion; and the heat source comprises an electric foil heater disposed along and thermally coupled to an exterior surface of the enclosure along the heater portion;

whereby the electric foil heater is operable for supplying heat for heating the exterior surface of the enclosure and the plurality of fins, which heat is transferrable to the coolant as the coolant flows across the plurality of fins.

19. The assembly of claim 12, wherein:

the enclosure comprises a cylindrical tubular housing including a longitudinal axis, a first section defining the accumulator portion, and a second section coupled to the first section and defining the heater portion, the membrane includes an O-ring between the first and second sections of the cylindrical tubular housing, and the membrane is generally perpendicular to the longitudinal axis when the accumulator portion is unpressurized; and/or the membrane is positioned within the enclosure such that the accumulator portion extends along about one-fourth of a length of the enclosure and such that the heater portion extends along about three-fourths of the length of the enclosure.

20. A system comprising the assembly of claim 12 and a source of pressurized fluid for supplying pressurized fluid into the interior of the accumulator portion, to thereby cause the membrane to flex, move, and/or deform in the direction away from the accumulator portion and towards the heater portion for causing the coolant within the interior of the heater portion to exit the interior of the heater portion via the outlet.

21. The assembly of claim 6, wherein the one or more surfaces comprise a plurality of extruded fins that protrude inwardly from an inner surface of the enclosure towards a center of the interior of the second portion and that are spaced apart around a perimeter of the inner surface of the enclosure along the second portion, such that the coolant may flow across the plurality of extruded fins as the coolant flows through the interior of the second portion and such that heat is transferrable from the plurality of extruded fins to the coolant.

22. The assembly of claim 5, wherein the mechanism comprises a spring to mechanically press or apply a mechanical spring force on the divider in order to flex, move, and/or deform the divider.

23. The assembly of claim 7, wherein the assembly further comprises an insert within the second portion that prevents pass cross talk and that channels the coolant flow between the first, second, and third passes.

24. The assembly of claim 1, wherein the assembly includes the first and second ports and the symmetric design such that either the first port and the second port are usable as the inlet or the outlet.

25. The assembly of claim 1, wherein the baffle comprises the plate having the one or more bleed holes, the plate configured to resist deforming due to force or pressure exerted by flowing coolant within the second portion and to resist the force or pressure caused by the flexing, moving, and/or deforming of the divider, whereby the plate is operable for at least reducing application of pressure on the divider from the coolant flowing within the interior of the second portion.

26. The assembly of claim 12, wherein the assembly further comprises one or more surfaces that protrude inwardly from an inner surface of the enclosure along the heater portion into the interior of the heater portion such that heat is transferrable from the one or more surfaces to the coolant within the interior of the heater portion.

27. The assembly of claim 26, wherein the one or more surfaces comprise a plurality of extruded fins that protrude inwardly from an inner surface of the enclosure towards a center of the interior of the heater portion and that are spaced apart around a perimeter of the inner surface of the enclosure along the heater portion, such that the coolant may flow across the plurality of extruded fins as the coolant flows through the interior of the heater portion and such that heat is transferrable from the plurality of extruded fins to the coolant.

28. The assembly of claim 12, wherein the assembly includes the first and second ports and the symmetric design such that either the first port and the second port are usable as the inlet or the outlet.

29. The assembly of claim 12, wherein the baffle comprises the plate having the one or more bleed holes, the plate configured to resist deforming due to force or pressure exerted by flowing coolant within the second portion and to resist the force or pressure caused by the flexing, moving, and/or deforming of the membrane, the one or more bleed holes configured to enable pressure changes due to flexing, moving, and/or deforming of the membrane to be transmitted throughout the heater portion, whereby the plate is operable for at least reducing application of pressure on the membrane from the coolant flowing within the interior of the heater portion.

30. The assembly of claim 15, wherein the mechanism comprises a spring to mechanically press or apply a mechanical spring force on the membrane in order to flex, move, and/or deform the membrane.

* * * * *